United States Patent [19]

Norigoe

[11] Patent Number: 4,611,393

[45] Date of Patent: Sep. 16, 1986

[54] PROCESS FOR PRODUCING A DOT PRINTER HEAD

[75] Inventor: Takashi Norigoe, Ohhito, Japan

[73] Assignee: Tokyo Electric Co., Ltd., Tokyo, Japan

[21] Appl. No.: 775,395

[22] Filed: Sep. 12, 1985

[30] Foreign Application Priority Data

Sep. 13, 1984 [JP] Japan ..... 59-192040

[51] Int. Cl.[4] ..... B41J 3/12; H01F 7/06

[52] U.S. Cl. ..... 29/602 R; 101/93.05; 346/141; 400/124

[58] Field of Search ..... 29/602 R, 433; 400/124; 101/93.05; 346/141

[56] References Cited

U.S. PATENT DOCUMENTS 4,433,926 2/1984 Isobe et al. ..... 400/124

*Primary Examiner*—Carl E. Hall

*Attorney, Agent, or Firm*—Oblon, Fisher, Spivak, McClelland & Maier

[57] ABSTRACT

The invention provides a process for producing a dot printer head wherein a plurality of needles having their ends arranged along a straight line have gradually increasing lengths towards opposite outer end ones thereof so that when the needles are being inserted into respective needle holes in a needle guide, they can be positioned one after another each under the guidance of a needle located outwardly adjacent thereto. Thus, even where an arrangement of needles is such that there remain some gaps between adjacent needles, the needles can be guided one after another beginning with the outermost ones thereof and be inserted smoothly into the needle holes.

5 Claims, 15 Drawing Figures

PROCESS FOR PRODUCING A DOT PRINTER HEAD

FIELD OF THE INVENTION AND RELATED ART STATEMENT

This invention relates to a process for producing a dot printer head and particularly to a process for producing a dot printer head which employs needles therein.

In assembling a dot printer head, it is very troublesome to thread a plurality of needles one by one through a needle guide secured to an end of a guide holder. To this end, an arrangement is proposed wherein ends of needles secured to armatures which are disposed radially are aligned forwardly of a needle guide in an inserting step wherein the needles are inserted at once into a guide holder, as disclosed in Japanese laid-open patent No. 56-37175.

Meanwhile, needle holes formed in a needle guide are a little greater than the thickness of needles and are formed in a predetermined pitch so as to prevent interference of adjacent ones of the needles.

Object and Summary of the Invention

It is a first object of the present invention to provide a process for producing a dot printer head which enables alignment of ends of a plurality of needles only by inserting the needles at once into a guide frame.

It is a second object of the invention to provide a process for producing a dot printer head which facilitates guidance of needles to predetermined positions of a needle guide.

Other objects of the invention will become apparent from the following description.

According to the present invention, as illustrated in FIG. 1(*a*), needles 9 among components which are formed into a unit as a magnet block are inserted into a tapered hole 22 from a rear end of a guide holder 18 and are aligned into a row by a guide hole 23 in the form of a slit formed in contiguous relationship to the tapered hole 22. In this instance, the needles 9 are formed to have a greater length toward outside so that the outermost needles are greater in length than the central needles.

Accordingly, as the needles 9 are inserted more deeply, the needles 9 which have rear ends disposed thus along a parabola or arcuate line are guided outwardly so that they are inserted into needle holes 24 in a needle guide 17 in order beginning with the outermost needles 9, as seen in FIG. 1(*b*). While the outermost needles 9 are guided by opposite ends of the guide hole 23 in the form of a slit, inner ones of the needles 9 are guided by guide faces provided by inner faces of outer needles 9 adjacent thereto and are introduced into the chamfered needle holes 24. If all the needles 9 are inserted into the needle guide 17 as shown in FIG. 1(*c*), they will have different extensions from the needle guide 17. Therefore, after a guide holder 18 is secured to the magnet block, the needles 19 are polished to a plane coplanar with a front face of the needle guide 17 as illustrated in FIG. 1(*d*).

DETAILED DESCRIPTION OF A PREFERRED EMBODIMENT

Figure 1A:
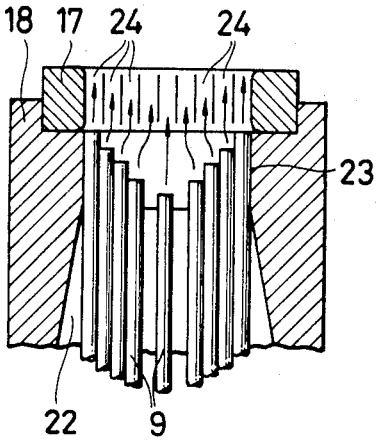
FIGS. 1(*a*), 1(*b*), 1(*c*) and 1(*d*) are horizontal sectional views illustrating different stages from beginning of insertion of needles into a guide holder to completion of finishing of the needles.
Figure 1B:
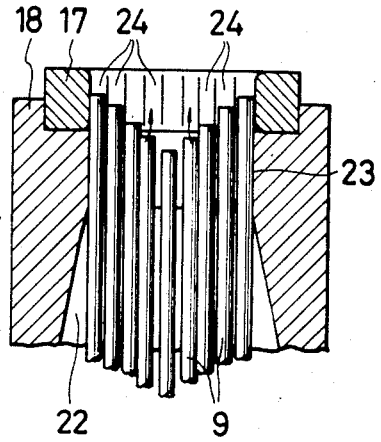
Figure 1C:
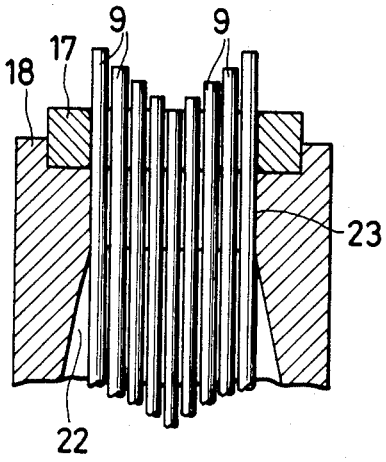
Figure 1D:
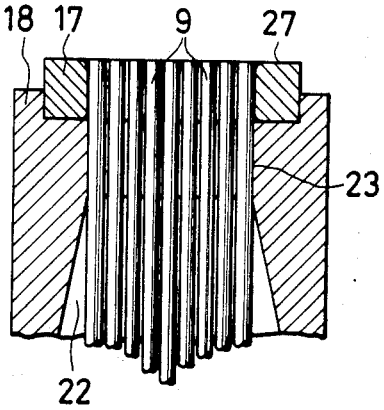

An embodiment of the present invention will now be described with reference to the accompanying drawings. As shown in FIG. 1, a cover 1, a PC plate 2, a case 3 and a yoke 4 are put one on another, and a plurality of screws 5, which will act also as guide poles after assembly, are passed through them and a plurality of guide poles 6 are erected on the yoke 4. A plurality of cores 7 are disposed radially around an outer periphery of the yoke 4, and coils 8 are mounted on the cores 7. An armature 10 to which needles 9 is secured is placed in opposing relationship to the cores 7 with the screws 5 and the guide poles 6 received therein. Then, a stopper 12 of aluminum having a ring 11 made of an elastic material and an armature guide 13 made of a synthetic resin material are put with the screws 5 fitted therein while projections 14 formed on the armature guide 13 are fitted into the armature, and then armature springs 15 are assembled to the armature guide 13 in opposing relationship to the armature 10, thereby forming a magnet block 16.

Figure 3:
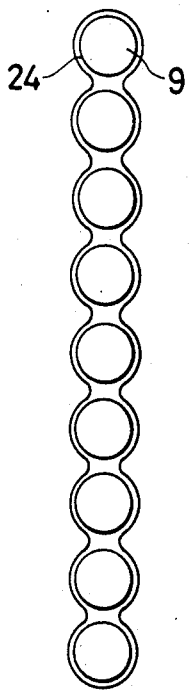
FIG. 3 is a front elevational view, in an enlarged scale, illustrating an arrangement of needle holes.
Figure 4:
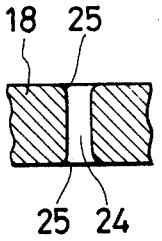
FIG. 4 is a horizontal sectional view of part of the needle guide illustrating a needle hole in a chamfered condition.

A guide holder 18 made of a synthetic resin material to which a needle guide 17 is secured has formed therein mounting holes 19 for passing the screws 5 therethrough, a mounting hole 20 for assembling to a carrier, a rear opening 21 having a large area, a tapered hole 22 having a sectional area which decreases from an end thereof adjacent or is tapered toward the rear opening 21, and a guide hole 23 in the form of a slit. The needle guide 17 has a plurality of needle holes 24 formed therein so as to allow the needles 9 to be arranged in a predetermined pitch in a row without interference thereamong. The needle holes 24 are formed in partly contiguous relationship as seen in FIG. 3 and are worked with chamfering 25 at opposite ends thereof as seen in FIG. 4. The guide hole 23 has a length and width sufficient to oppose to all the needle holes 24.

Figure 2:
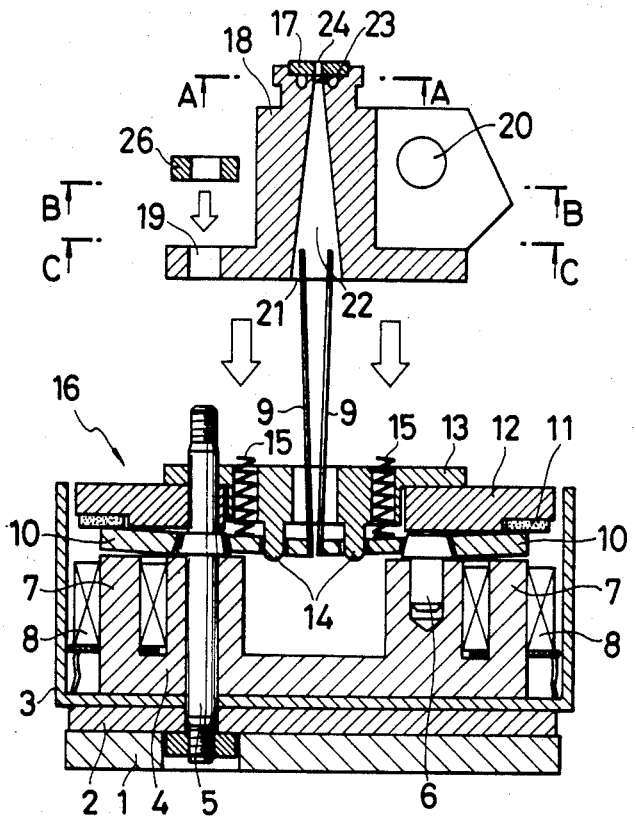
FIG. 2 is a horizontal sectional view, in a reduced scale, illustrating a magnet holder and a guide holder.
Figure 5:
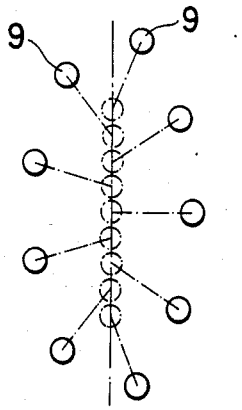
FIG. 5 is an illustrative view showing arrangements of ends of needles before and after the magnet block and the guide holder are joined together.
Figure 6A:
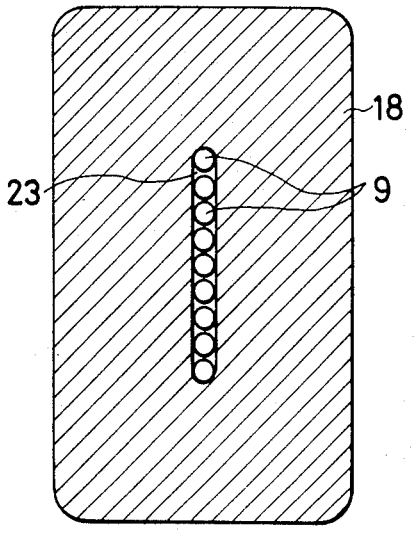
FIGS. 6(*a*), 6(*b*) and 6(*c*) are vertical sectional views illustrating sectional shapes of a tapered hole taken along lines A—A, B—B and C—C of FIG. 2, respectively.
Figure 6B:
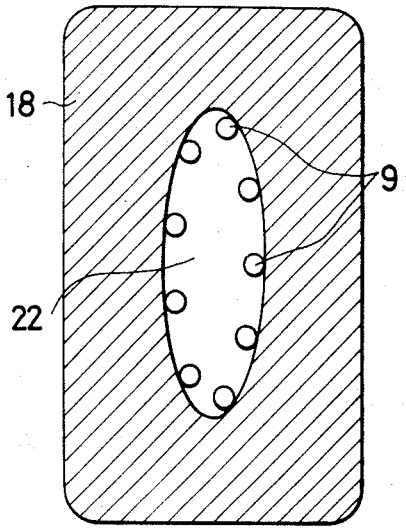
Figure 6C:
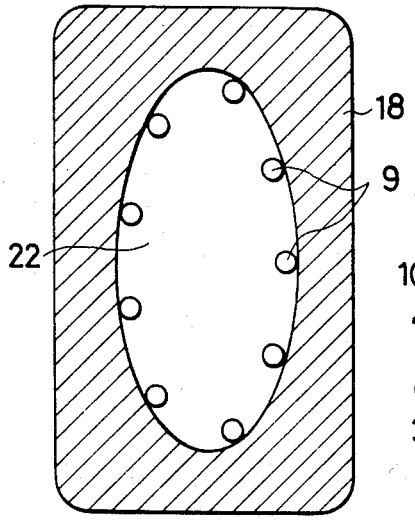
Figure 7:
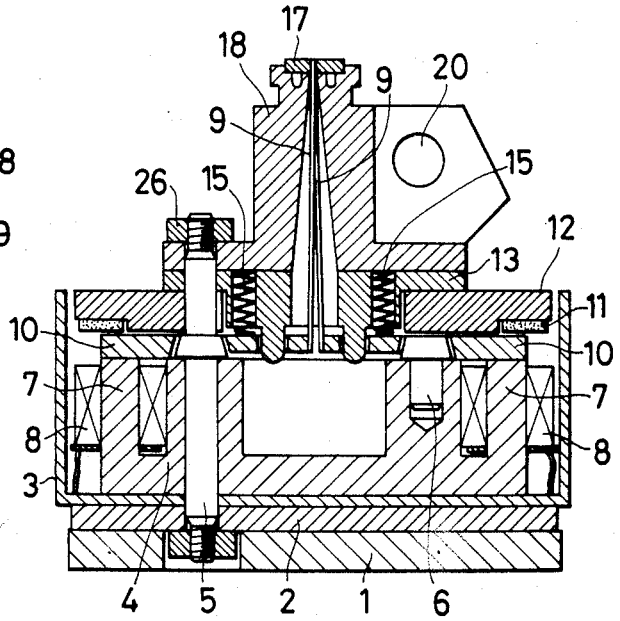
FIG. 7 is a horizontal sectional view, in a reduced scale, illustrating an assembled condition of a dot printer head.

In the condition wherein the magnet block 16 is formed as shown in FIG. 2, the needles 9 are open so that the ends thereof are positioned as shown in full lines in FIG. 5. Then, in order to assemble the magnet block 16 and the guide holder 18, the needles 9 are inserted into the tapered hole 22 from the opening 21 at the rear end of the guide holder 18 as shown in FIG. 1(*a*). The needles 9 are directed inwardly by the inner periphery of the tapered hole 22 which become thinner toward the end thereof until they are aligned in a row by the guide hole 23 in the form of a slit as shown in FIGS. 1(*a*) and 6. As seen from FIG. 1(*a*), if the needles 9 are differentiated in length from each other such that the length is greatest at the needles 9 which are to be inserted into the opposite end needles holes 24 and decreases towards the innermost needles 9, as the needles 9 are inserted further deeply into the guide hole 23, the outermost needles 9 will be guided by the opposite end edges of the guide hole 23 and inserted into the opposite outermost needle holes 24. Since the needles 9 are forcibly aligned into a row from the open position thereof, the inner needles 9 are deflected inwardly by the outer needles 9 in the guide hole 23 and only central needles 9 are in an unstable condition. Accordingly, the inner needles 9 are each guided by a guide face provided by an inside face of an outer adjacent needle 9 thereto and are inserted into the respective needle holes 24 while the central needle 9 is inserted into the central needle hole 24 under the guidance of a guide face provided by a side face of either one of opposite needles 9 adjacent thereto, as seen in FIG. 1(*b*). Referring to FIG. 1(*a*), while the needle 9 are dislocated a greater distance from the corresponding needle holes 24 toward the center one, they are not inserted into the needle holes 24 at once but are inserted into and corrected in position by the respective needle holes 24 one after another beginning with the outermost ones. Accordingly, not only the outermost ones but also the central one of the needles 9 are inserted in the same condition. Slight dislocation of the needles 9 just before insertion could be corrected by the chamfered faces 25.

Positions of all the needles 9 inserted in the needle guide 17 in this manner are shown in dot and dash lines in FIG. 5 and also in FIG. 1(*c*), and outer extensions of the needles 9 are thus different from each other. Then, the magnet block 16 and the guide holder 18 are assembled to each other by the screws 9 and nuts 26, and thereafter the needles 9 are polished in a plane 27 along the front face of the needle guide 17 as shown in FIG. 1(*d*). Accordingly, a troublesome operation to position the needles 9 one by one to insert the same into the corresponding needle 24 can be eliminated.

It is to be noted that the dot printer head which has been assembled in this manner will be installed onto a printer, and such printing operation will be described briefly. If a particular one or ones of the coils 8 are energized, the corresponding armatures 10 are pivoted around fulcra provided by contact points thereof with the yoke 4 and are attracted to the corresponding cores 7, thereby causing the corresponding needles 9 to impact upon a platen.

Figure 8A:
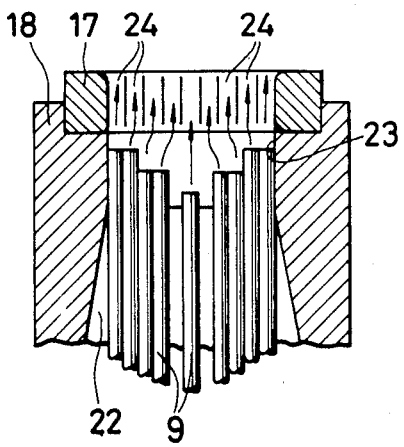
FIGS. 8(*a*), 8(*b*) and 8(*c*) are horizontal sectional views illustrating needles in an inserted condition where every two adjacent ones of the needles are formed in a same length.
Figure 8B:
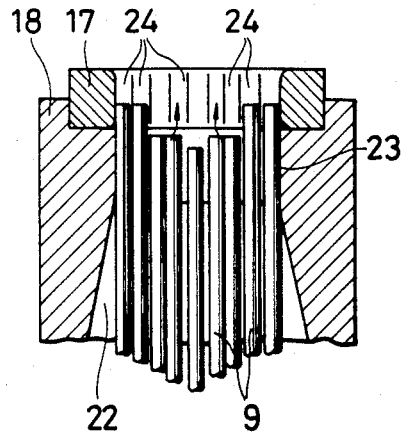
Figure 8C:
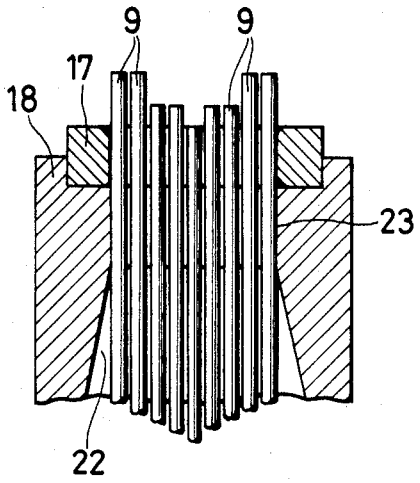

Referring now to FIG. 8, needles 9 having a same length in each pair are arranged. In this arrangement, the needles 9 are guided by each pair beginning with the outermost pair, and the inner pairs of the needles 9 are guided in a similar manner to that described above so that the needles 9 will be smoothly inserted into the needle holes 24 at last.

I claim:

1. A process for producing a dot printer head, comprising:

an inserting step wherein a plurality of needles are inserted at once into a tapered hole formed in a guide holder and tapered toward an end thereof, said needles each having a rear end thereof secured to a corresponding one of a plurality of armatures which are opposed to and form a magnet block together with a yoke and a plurality of radially arranged cores, said needles having gradually increasing entire lengths toward opposite ends of a straight line along which forward ends of said needles are aligned;

a guide holder assembling step wherein said needles are inserted one after another beginning with the longest outermost ones thereof into a plurality of needle holes in said needle guide which are provided forwardly of said guide holder and are chamfered at entrances thereof for holding said needles without any interference therebetween while inner ones of said needles are each inserted into the corresponding needle hole under the guidance of a guide face provided by an inner face of an outer needle adjacent thereto and then said guide holder is secured to said magnet block; and a finishing step wherein said needles which extend in different lengths from said guide holder are machined in a plane parallel to a front face of said needle guide.

2. A process for producing a dot printer head according to claim 1, wherein said tapered hole is operable to align the forward ends of said needles of different lengths to a linear line as said needles are inserted into said tapered hole.

3. A process for producing a dot printer head according to claim 1, wherein the forward ends of said needles are machined to said parallel plane while said guide holder and said magnet block are temporarily held fixed.

4. A process for producing a dot printer head, comprising:

an inserting step wherein a plurality of needles are inserted at once into a tapered hole formed in a guide holder and tapered toward an end thereof, said needles each having a rear end thereof secured to a corresponding one of a plurality of armatures which are opposed to and form a magnet block together with a yoke and a plurality of radially arranged cores, said needles having gradually increasing entire lengths either individually or in pairs toward opposite ends of a straight line along which forward ends of said needles are aligned;

a guide holder assembling step wherein said needles are inserted one after another beginning with the longest outermost ones thereof into a plurality of needle holes in said needle guide which are provided forwardly of said guide holder and are chamfered at entrances thereof for holding said needles without any interference therebetween while inner ones of said needles are each inserted into the corresponding needle hole under the guidance of a guide face provided by an inner face of an outer needle adjacent thereto and then said guide holder is secured to said magnet block; and a finishing step wherein said needles which extend in different lengths from said guide holder are machined in a plane parallel to a front face of said needle guide.

5. A process for producing a dot printer head, comprising:

an inserting step wherein a plurality of needles are inserted at once into a tapered hole formed in a guide holder and tapered toward an end thereof and then into a guide hole in the form of a slit contiguous to said tapered hole, said needles each having a rear end thereof secured to a corresponding one of a plurality of armatures which are opposed to and form a magnet block together with a yoke and a plurality of radially arranged cores, said needles having gradually increasing entire lengths either individually or in pairs toward opposite ends of a straight line along which forward ends of said needles are aligned;

a guide holder assembling step wherein said needles are inserted one after another beginning with the longest outermost ones thereof into a plurality of needle holes in said needle guide which are provided forwardly of said guide holder in such a manner as to have a length of arrangement substantially equal to the length of said guide hole and are chamfered at entrances thereof for holding said needles without any interference therebetween while inner ones of said needles are each inserted into the corresponding needle hole under the guidance of a guide face provided by an inner face of an outer needle adjacent thereto and then said guide holder is secured to said magnet block; and a finishing step wherein said needles which extend in different lengths from said guide holder are machined in a plane parallel to a front face of said needle guide.

* * * * *